US005522410A

United States Patent [19]

Meilleur

[11] Patent Number: 5,522,410

[45] Date of Patent: Jun. 4, 1996

[54] PORTABLE SINGLE-CUP WASHER

[76] Inventor: Michel Meilleur, 7389 rue Saint-Denis, Montréal, Qc, Canada, H2R 2E5

[21] Appl. No.: 362,140

[22] Filed: Dec. 22, 1994

[51] Int. Cl.[6] ..... B08B 3/02; B08B 9/08

[52] U.S. Cl. ..... 134/57 R; 134/95.2; 134/108; 134/168 R; 134/170; 134/176

[58] Field of Search ..... 134/24, 57 R, 134/58 R, 95.2, 108, 167 R, 168 R, 170, 176, 179, 53, 54, 152

[56] References Cited

U.S. PATENT DOCUMENTS

| | | | |
|---|---|---|---|
| 652,373 | 6/1900 | Rowe | 134/53 |
| 683,111 | 9/1901 | Fisher et al. | 134/170 X |
| 1,954,222 | 4/1934 | Olson | 134/167 R |
| 2,065,466 | 12/1936 | Horn | 134/170 |
| 2,764,171 | 9/1956 | Nolte | 134/176 X |
| 4,422,466 | 12/1983 | Schafer | 134/170 X |

FOREIGN PATENT DOCUMENTS

| | | |
|---|---|---|
| 1077805 | 5/1980 | Canada . |
| 1240239 | 8/1988 | Canada . |
| 2070012 | 8/1993 | Canada . |

*Primary Examiner*—Philip R. Coe
*Attorney, Agent, or Firm*—Antoine H. Gauvin

[57] ABSTRACT

This single portable single-cup washer comprises a container having a locking cover. A water driven elongated member has a plurality of water-spray nozzles there along and at its base radial blades defining radial water-spray nozzles, and water passages for the water-spray nozzles. The elongated member is rotatably mounted at its base, inside the container and has a water inlet joining the water passage for revolving that member. The container has at the bottom a water-outlet. A cup holder is mounted onto the container above and adjacent the radial blades, for receiving a cup upside down and a spring fasten to the locking cover to urge against the bottom of the cup and thereby the top of the cup is pressing against the cup holder and thereby frictionally holding the cup and counteracting the water against the cup.

14 Claims, 2 Drawing Sheets

PORTABLE SINGLE-CUP WASHER

BACKGROUND OF THE INVENTION

1. Field of the invention

This invention relates to a portable single-vessel washer. This invention relates in particular to a water saving apparatus for washing a single cup and to a method of washing a cup.

By "cup" throughout the specification, including the disclosure and the claims, it is meant: a drinking vessel, including a glass, a beaker, a mug, an old fashion, a high ball, a tumbler and the like, and preferably an ordinary coffee cup.

2. Description of Related Art

As far as Applicant is aware, there is no device that is known for washing a single cup at a time, and even less of minimizing the amount of water during the washing of a cup.

Dishwashers that are known generally discloses telescopic axial members. Recent patents are disclosing improvements thereof, for instance:

Canadian Patent 2,070,012, dated 1993/08/22, as invented by Dennis Purtilo, and

Canadian Patent 1,240,239, dated 1988/08/09, as invented by Hoffman et al.

SUMMARY OF THE INVENTION

The invention aims at making possible the washing of a single cup, in working places or for single persons while reducing or minimizing water consumption.

Broadly stated the invention is directed to a portable single-cup washer comprising:

a container having a locking cover, a water driven elongated member including a top and a base, a plurality of water-spray nozzles along said elongated member, and a water passage from said base, inside said elongated member to said water-spray nozzles of said elongated member, said elongated member being insertable within a cup having a top, a bottom, an inner wall and outer wall, and said elongated member having mounted thereto at its base radial blades defining radial water-spray nozzles, and including radial water passages, from said water passage from said base to said water-spray nozzles of said elongated member, for said radial water-spray nozzles, said elongated member being rotatably mounted at its base, inside said container and being provided with a water inlet, joining said water passage from said base to said water-spray nozzles of said elongated member, for revolving in a given direction said water driven elongated member, and thereby said radial blades, said container having a slanted bottom, said slanted bottom having a lowest part, and being provided at said lowest part of said bottom, with a water-outlet for draining water from the container, and a cup holder mounted onto said container above and adjacent said radial blades,for receiving said cup upside down, said cup holder being provided with a central aperture to allow passage of said elongated member, said radial water-spray nozzles being oriented for water to leave said nozzles counter wise to said given direction and upwardly toward the outer wall of said cup to wash said outer wall, and the water-spray nozzles of the elongated member are also upwardly directed toward the inner wall of said cup, said locking cover having an inner wall, and said inner wall having mounted thereon a means to urge against the bottom of said cup and thereby the top of said cup pressing against said cup holder and thereby frictionally holding said cup, and counteracting the water against said cup, whereby, after placing a cup upside down on said cup holder and locking the cover of said container, and thereby holding said cup upside down, water is fed under pressure in the water inlet in order to enable revolution in said given direction of said water driven elongated member and said radial blades, and said elongated member surrounded by the inner wall of said cup, said water being solely responsible for the torque, and simultaneously washing the inner wall and the outer wall of the cup positioned upside down, the water after being used for washing the cup, leaving said water-outlet by gravity.

In a preferred embodiment, the invention is directed to a portable single-cup washer comprising:

a container having a locking cover, a water driven telescopic member including a base, a plurality of water-spray nozzles along said telescopic member, and a water passage from said base, inside said telescopic member to said water-spray nozzles of said telescopic member, said telescopic member being displaceable within a cup having a top, a bottom, an inner wall and an outer wall, and said telescopic member having mounted thereto at its base radial blades defining radial water-spray nozzles, and including radial water passages, from said water passage from said base to said water-spray nozzles of said telescopic member, for said radial water-spray nozzles, said telescopic member being rotatably mounted at its base, inside said container and being provided with a water inlet, joining said water passage from said base to said water-spray nozzles of said telescopic member, for revolving in a given direction said water driven telescopic member, and thereby said radial blades, said container having a slanted bottom, said slanted bottom having a lowest part, and being provided at said lowest part of said bottom, with a water-outlet for draining water from the container, and a cup holder mounted onto said container above and adjacent said radial blades, for receiving said cup upside down, said cup holder being provided with a central aperture to allow passage of said telescopic member, said radial water-spray nozzles being oriented for water to leave said nozzles counter wise to said given direction and upwardly toward the outer wall of said cup to wash said outer wall, and the water-spray nozzles of the elongated member are also upwardly directed toward the inner wall of said cup, said locking cover having an inner wall, and said inner wall having mounted thereon a means to urge against the bottom of said cup and thereby the top of said cup pressing against said cup holder and thereby frictionally holding said cup, and counteracting the water against said cup, whereby, after placing a cup upside down on said cup holder and locking the cover of said container, and thereby holding said cup upside down, water is fed under pressure in the water inlet in order to enable revolution in said given direction of said water driven telescopic member and said radial blades, and said telescopic member rising within the inner wall of said cup, against said bottom of said cup, said water being solely responsible for the torque, and simultaneously washing the inner wall and the outer wall of the cup positioned upside down, the water after being used for washing the cup, leaving said water-outlet by gravity.

The invention is also directed to a method to clean a single-cup which comprises:

in a container having a top cover and a water-driven, rotatably-mounted, elongated member having water-spray nozzles, and said elongated member having a base and near said base on said elongated member radial blades defining radial water-spray nozzles, holding a single cup upside down as to receive therein said elongated member, said cup having a top, a bottom, an inner wall and outer wall, simultaneously directing water from said water-spray nozzles of said elongated member to said inner wall and water from said radial water-spray nozzles against said outer wall of said cup.

Further embodiments of the invention will be described herein below.

DESCRIPTION OF THE DRAWINGS

In the drawings which illustrate some of the preferred ways of carrying out the invention.

DESCRIPTION OF SOME OF THE PREFERRED WAYS OF CARRYING OUT THE INVENTION

Figure 1:
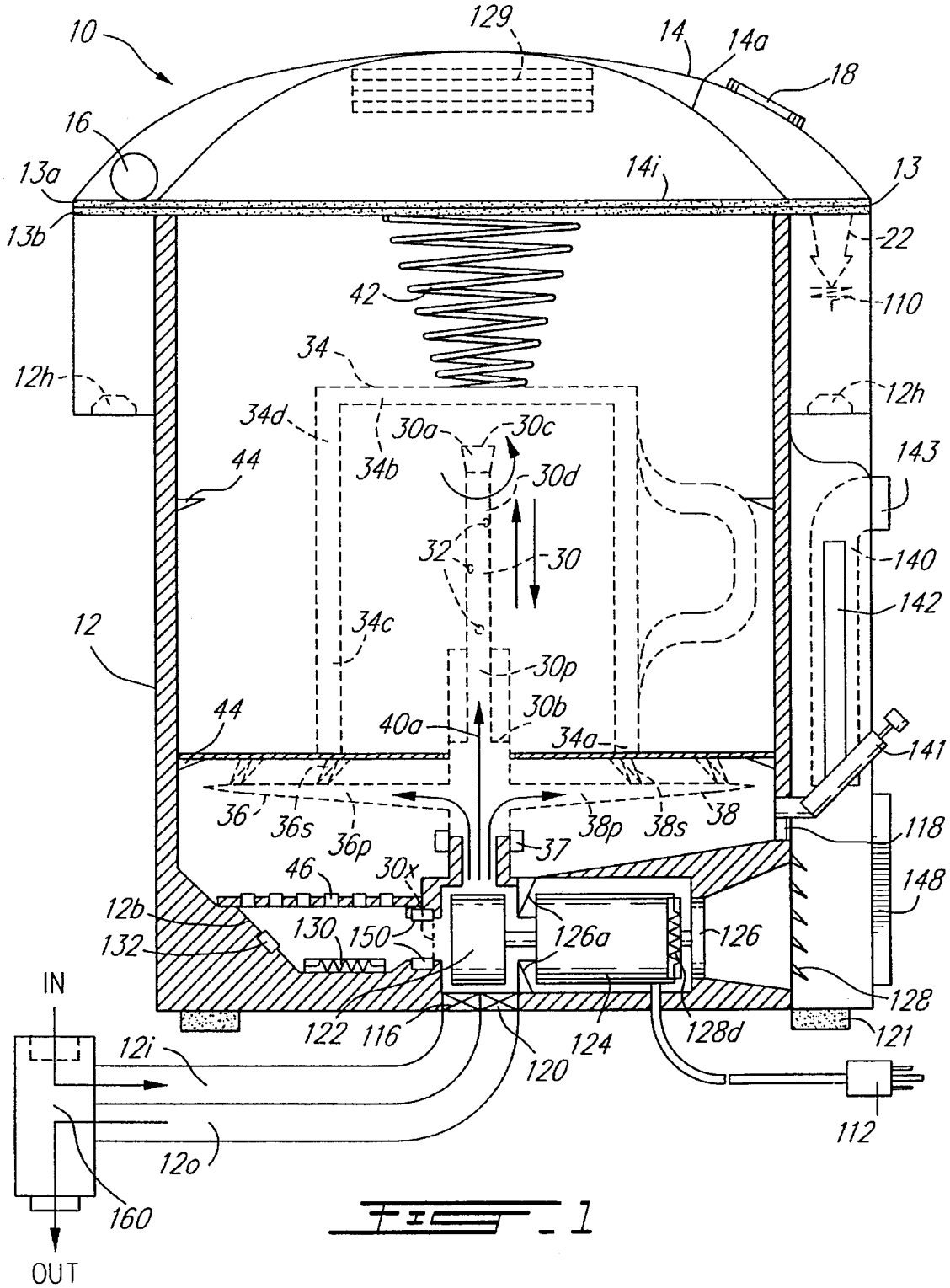
FIG. 1 is a side view partly in cross-section of a portable single-cup washer.

As shown in FIG. 1, a portable single-cup washer 10 comprises a container 12 having a cover 14, seals 13*a*, 13*b* for tight fitting of the cover on said container to prevent water leaks, a lock 18 or a latch, for locking the cover 14: the cover may be hinged as shown at 16. Although preferably provided with a locking device 18, if desired, instead the container 12 may have other means to lock for instance a complementary receiving lip for the cover provided with engaging member as found in the art of Presto wares.

The container 12 may also be provided with resilent or vibration-insulator, level-adjustable feet such as 12*f*; and handles such as 12*h*.

A water driven member 30, preferably telescopic, including a top 30*a* and a base 30*b*, has a plurality of water-spray nozzles 32 along said elongated member and a water passage 30*p* from said base, inside said elongated member to said water-spray nozzles of said elongated member.

The elongated member is insertable and either fixed or preferably displaceable within a cup outlined in dotted lines at 34 and having a top 34*a*, a bottom 34*b*, an inner wall 34*c* and an outer wall 34*d*, and said elongated member has mounted thereto at its base radial blades such as 36, 38, (two being shown for clarity sake but may include 3 or more, if desired) defining radial water-spray nozzles, 36*s* and 38*s* and including radial water passages 36*p* and 38*p*, from said water passage 30*p* from said base to said water-spray nozzles of said elongated member, for said radial water-spray nozzles. Preferably, the elongated member is displaceable so as to rise up to the top of said cup. As a way of example the telescopic member may be allowed to raise up to 6 inches.

The elongated member is rotatably mounted at its base 30*b*, inside said container 12 with a bearing support 37 and is provided with a water inlet 12*i*, joining said water passage for said axial water-spray nozzle for revolving in a given direction as shown at 30*d* said water driven elongated member, and thereby said radial blades.

Preferably the telescopic member at its top, is provided with a substantially frictionless spacer 30*c*, said spacer rising up to the top of said cup and thereby spacing said telescopic member from the top of said cup.

The container has a slanted bottom 12*b* and is provided at its lowest bottom with a water-outlet 12*o* for draining water from the container, and a cup holder 40, by means of a screen, or netting, or wires and the like, is mounted onto said container for receiving said cup 34 upside down, said cup holder being provided with a central passage 40*a* to allow passage of said elongated member 30 having water-spray nozzles.

The cup holder is preferably adjustable on a plurality of adjustable height supports 44, only two of which are shown for sake of clarity.

The radial water-spray nozzles are oriented for water to leave said nozzles counter wise to said given direction 30*c* and upwardly toward the outer wall of said cup to wash said outer wall, and the water-spray nozzles of the elongated member are also upwardly directed toward the inner wall of said cup. The water leaves the nozzles at an angle from about 15° to 60°. The water-spray nozzles of the elongated member may define, at its top 30*a*, a rose or shower head, for better cleaning of the bottom of the cup. The locking cover 14 has an inner wall 14*i* and said inner wall has mounted thereon a means 42, for instance a coil spring, to urge against the bottom of the cup and thereby the top of the cup is pressing against the holder 40 and thereby frictionally holding the cup, and counteracting the water against the cup, whereby after placing a cup upside down on the cup holder and locking the cover of the container, and thereby holding the cup upside down, water is fed under pressure in the water inlet in order to enable revolution in the given direction of the water driven elongated member and the radial blades, the water being solely responsible for the torque, and simultaneously washing the inner wall and the outer wall of the cup positioned upside down, the water after being used for washing the cup, leaving via the water-outlet by gravity; and preferably when the elongated member is telescopic, the elongated member rising in the interior of the cup against the bottom of the cup.

In this simplest mode, when soap is desired, it is simply poured into the water inlet or directly into the container.

In a particular embodiment, the nozzles of the telescopic member, are oriented for water to leave the nozzles counter wise to the given direction 30*d*.

In general the elongated member has a diameter ranging from ¼ to 1 inch, and preferably from ⅓ to ⅝ inch, and the radial blades have each a length ranging from 2 to 6 inches.

Preferably the water outlet is provided with a filter, for instance filter 46.

The portable single-cup washer is described above, in its simplest mode or form; no electricity being used and the water inlet 12*i* is directly connected to the water passage 30*p*, the passage 30*p* being closed at 30*x*. However in another version or mode, the portable single-cup washer includes a on-off switch 110 operatively mounted adjacent the cover, and connected via electrical wiring 112 to be connected to a suitable electrical source and linking in series:

a solenoid water valve 116 joining the water inlet 12*i*, and to a water level sensing device or overflow protection switch 118, for maintaining the water inside the container below a given level, whereby on opening the on-off switch, the solenoid water valve is actuated so as to allow water to flow through the water inlet, but if for any reason the water in the container exceeds a given level the sensing device cuts off the electric current, and thereby the solenoid water valve closing the water inlet, and the on-off switch opening and closing the solenoid water valve upon closing and opening the cover.

The portable single-cup washer as described above is in its simplest mode or form, no electricity being used, may instead include:

a on-off switch 110 operatively mounted adjacent the cover, and connected via electrical wiring 112 to be connected to a suitable electrical source 112 and linking in series:

the solenoid water valve 116 joining said water inlet, and to the water level sensing device 118 for maintaining the water inside said container below a given level, and in parallel:

a solenoid water valve 120 joining the water outlet 12*o*, a water recirculating pump 122, operated via an electric motor 124, for pumping water adjacent the slanted bottom but above the water outlet, and for recirculating the water into the water passage from the base, obtained when the passage 30*p* is opened at 30*x*, a water-saving double switch 123 is wired so as to simultaneously actuate the water circulating pump and bypass all other electrical components described above depending upon the the current of the on-off switch, whereby on opening the on-off switch, the solenoid water valve is actuated so as to allow water to flow through the water inlet, but if for any reason the water in the container exceeds a given level said sensing device cuts the electric current thereby said solenoid water valve closing said water inlet, and upon actuating said double switch, the water in said container is recirculated, and on turning off said double switch the solenoid water inlet and outlet valve are open.

If desired the single portable single-cup washer may further include a photosensor 150 to monitor the purity of the water during water recirculation and give a signal and stop water recirculation when the water is improper for recirculation as is well known.

If desired the single portable single-cup washer may further include a drying stage by means of a check valve 126*a*, and an air impeller 126 driven by motor 124, pulling ambient air from an air inlet 128 to the water passage 30*p*, via a air heater 128*d*, while maintening closed the solenoid water valve 116 of the water inlet and the solenoid water valve 120 of the water outlet; and the wet air leaving the container 12 via an evaporating grill 129 provided on the cover 14. The motor 124 is operatively connected to a on-off switch or the drying switch closing simultaneously the solenoid water valve 116, 120. The check valve 126*a* closes when a positive pressure is exerted by water in the container 12.

A water heating element 130 may also be inserted in the path of the water being circulated by said water circulating pump, and a temperature sensing device or thermostat may also be incorporated to monitor heating and or to limit heating below a given temperature. This heating element may be independently connected with an on-off switch, for instance in parallel on the current directed to the water recirculating pump.

A soap dispenser may also be incorporated, either on-line in the water inlet with a venturi as is well known in the art; or independently as is shown with soap dispenser 140 having soap inlet 143 and a soap level indicator 142, and connected to a manually soap push button 151.

Figure 2:
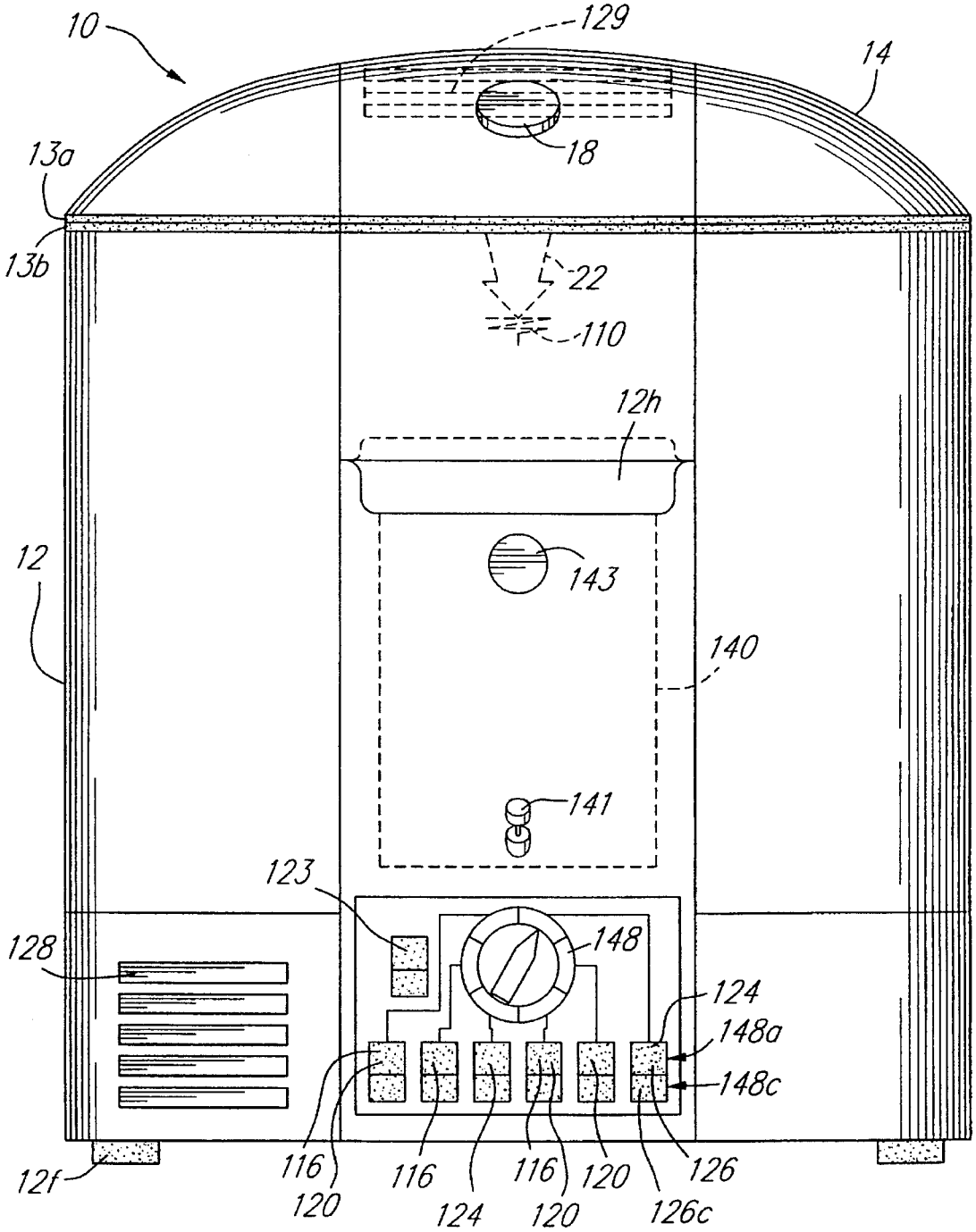
FIG. 2 is a front view of the portable single-cup washer.

Also if desired, as shown in FIG. 2, a clock timer or programmer 148 may be provided and connected as is well known in the art. For instance, in a first stage a current is fed to the solenoid water valve 116, 120 in order to rinse. The current to valve 120 is then cut, and water goes up to the water sensing device which being actuated cuts off the current to valve 116.

In a second stage the water recirculating pump 122 is operated by feeding current to the electric motor 124, for pumping water adjacent the slanted bottom but above the water outlet, and for recirculating the water, unless indicated otherwise by the photosensor 150 which monitors the purity of the water during water recirculation and gives a signal and stops water recirculation when the water is improper for recirculation; this second stage is a water saving step;

in a third stage a current is fed to the solenoid water valve 116, 120 in order to rinse. The current to valve 116 is then cut;

in a fourth stage a time lag is given for maintaining open outlet valve 120 to allow full drainage of the water, then the electric motor is fed an electric current, and since no positive pressure is exerted on the check valve 126*a*, drying air is introduced.

If desired pilot lights as shown at 148*a* may be provided as shown below the clock timer or programmer 148.

Instead of the clock timer or programmer 148 push buttons as shown at 148*c* with or without pilot lights may be provided as shown at 148*a*.

The numbers over the pilot lights indicate where the current from the push button is directed and/or from the corresponding sector of the clock timer or programmer 148.

The water inlet 12*i* and the water outlet 12*o* may be connected to a water inlet/water outlet utility 160, permanently or not as desired.

The advantage of having the cup holder adjustable on a plurality of adjustable height supports 44 is also in order to allow washing of the saucer and the spoon, when desired.

While some of the preferred embodiments have been described herein above, it is to be understood that the invention is not to be construed as limited to these preferred embodiments, as many modifications and variations are possible within the spirit and scope of the appended claims.

I claim:

1. A single portable single-cup washer comprising:

a container having a locking cover, a water driven elongated member including a top and a base, a plurality of water-spray nozzles along said elongated member, and a water passage from said base, inside said elongated member to said water-spray nozzles of said elongated member, said elongated member being insertable within a cup having a top, a bottom, an inner wall and outer wall, and said elongated member having mounted thereto at its base radial blades defining radial water-spray nozzles, and including radial water passages, from said water passage from said base to said water-spray nozzles of said elongated member, for said radial water-spray nozzles, said elongated member being rotatably mounted at its base, inside said container and being provided with a water inlet, joining said water passage from said base to said water-spray nozzles of said elongated member, for revolving in a given direction said water driven elongated member, and thereby said radial blades, said container having a slanted bottom, said slanted bottom having a lowest part, and being provided at said lowest part of said bottom, with a water-outlet for draining water from the container, and a cup holder mounted onto said container above and adjacent said radial blades,for receiving said cup upside down, said cup holder being provided with a central aperture to allow passage of said elongated member, said radial water-spray nozzles being oriented for water to leave said nozzles counter wise to said given direction and upwardly toward the outer wall of said cup to wash said outer wall, and the water-spray nozzles of the elongated member are also upwardly directed toward the inner wall of said cup, said locking cover having an inner wall, and said inner wall having mounted thereon a means to urge against the bottom of said cup and thereby the top of said cup pressing against said cup holder and thereby frictionally holding said cup, and counteracting the water against said cup, whereby, after placing a cup upside down on said cup holder and locking the cover of said container, and thereby holding said cup upside down, water is fed under pressure in the water inlet in order to enable revolution in said given direction of said water driven elongated member and said radial blades, and said elongated member surrounded by the inner wall of said cup, said water being solely responsible for the torque, and simultaneously washing the inner wall and the outer wall of the cup positioned upside down, the water after being used for washing the cup, leaving said water-outlet by gravity.

2. A single portable single-cup washer comprising:

a container having a locking cover, a water driven telescopic member including a base, a plurality of water-spray nozzles along said telescopic member, and a water passage from said base, inside said telescopic member to said water-spray nozzles of said telescopic member, said telescopic member being displaceable within a cup having a top, a bottom, an inner wall and an outer wall, and said telescopic member having mounted thereto at its base radial blades defining radial water-spray nozzles, and including radial water passages, from said water passage from said base to said water-spray nozzles of said telescopic member, for said radial water-spray nozzles, said telescopic member being rotatably mounted at its base, inside said container and being provided with a water inlet, joining said water passage from said base to said water-spray nozzles of said telescopic member, for revolving in a given direction said water driven telescopic member, and thereby said radial blades, said container having a slanted bottom, said slanted bottom having a lowest part, and being provided at said lowest part of said bottom, with a water-outlet for draining water from the container, and a cup holder mounted onto said container above and adjacent said radial blades,for receiving said cup upside down, said cup holder being provided with a central aperture to allow passage of said telescopic member, said radial water-spray nozzles being oriented for water to leave said nozzles counter wise to said given direction and upwardly toward the outer wall of said cup to wash said outer wall, and the water-spray nozzles of the elongated member are also upwardly directed toward the inner wall of said cup, said locking cover having an inner wall, and said inner wall having mounted thereon a means to urge against the bottom of said cup and thereby the top of said cup pressing against said cup holder and thereby frictionally holding said cup, and counteracting the water against said cup, whereby, after placing a cup upside down on said cup holder and locking the cover of said container, and thereby holding said cup upside down, water is fed under pressure in the water inlet in order to enable revolution in said given direction of said water driven telescopic member and said radial blades, and said telescopic member rising within the inner wall of said cup, against said bottom of said cup, said water being solely responsible for the torque, and simultaneously washing the inner wall and the outer wall of the cup positioned upside down, the water after being used for washing the cup, leaving said water-outlet by gravity.

3. The portable single-cup washer as defined in claim 2, wherein the nozzles of said telescopic member, are oriented for water to leave said nozzles counter wise to said given direction.

4. The portable single-cup washer as defined in claim 2, wherein said telescopic member has a diameter, said diameter ranging from from ¼ to 1 inch.

5. The portable single-cup washer as defined in claim 2, wherein said telescopic member is displaceable so as to rise up to the top of said cup.

6. The portable single-cup washer as defined in claim 2, further including a on-off switch operatively mounted adjacent said cover, and connected via electrical wiring to be connected to a suitable electrical source and linking in series:

a solenoid water valve joining said water inlet, and a water level sensing device for maintaining the water inside said container below a given level, whereby on opening the on-off switch, the solenoid water valve is actuated so as to allow water to flow through the water inlet, but if for any reason the water in the container exceeds a given level said sensing device cuts the electric current thereby said solenoid water valve closing said water inlet, said on-off switch opening and closing said solenoid water valve upon closing and opening said cover.

7. The portable single-cup washer as defined in claim 2, further including a on-off switch operatively mounted adjacent said cover, and connected via electrical wiring to be connected to a suitable electrical source and linking in series:

a solenoid water valve joining said water inlet, and to a water level sensing device for maintaining the water inside said container below a given level, and in parallel:

a solenoid water valve joining said water outlet;

a water recirculating pump for pumping water adjacent said slanted bottom but above said outlet, and for recirculating said water into said water passage from said base, a water-saving double switch for simultaneously actuating said water circulating pump and cutting said current to said on-off switch, whereby on opening the on-off switch, the solenoid water valve is actuated so as to allow water to flow through the water inlet, but if for any reason the water in the container exceeds a given level said sensing device cuts the electric current thereby said solenoid water valve closing said water inlet and upon actuating said double switch, the water in said container is recirculated, and on turning off said double switch the solenoid water inlet and outlet valve are open.

8. The portable single-cup washer as defined in claim 7, further including a heating element in association with said recirculating pump, for rising the temperature of the water recirculated via said recirculating pump.

9. The portable single-cup washer as defined in claim 2, further including a on-off switch operatively mounted adjacent said cover, and connected via electrical wiring to be connected to a suitable electrical source and linking in series:

a solenoid water valve inlet joining said water inlet, and to a water level sensing device for maintaining the water inside said container below a given level, and in parallel:

a solenoid water valve outlet joining said water outlet;

a water recirculating pump for pumping water adjacent said slanted bottom but above said outlet, and for recirculating said water into said water passage from said base, a water-saving double switch for simultaneously actuating said water circulating pump and cutting said current to said on-off switch, and a clock timer so that:

in a first stage a current is fed to the solenoid water valves inlet and outlet in order to rinse, the current to the solenoid water valve outlet is then cut, and water goes up to the water sensing device which being actuated cuts off the current to the solenoid water valve inlet;

in a second water saving stage the water recirculating pump is operated by feeding current to the electric motor, for pumping water adjacent the slanted bottom but above the water outlet, and for recirculating the water, unless indicated otherwise by the photosensor monitoring the purity of the water during water recirculation and gives a signal and stops water recirculation when the water is improper for recirculation;

in a third stage a current is fed to the solenoid water valves inlet and outlet in order to rinse, the current to valve water valve inlet is then cut;

in a fourth stage a time lag is given for maintaining open the water outlet valve in order to allow full drainage of the water, then the electric motor is fed an electric current, and drying air is introduced.

10. The portable single-cup washer as defined in claim 2, wherein said telescopic member at its top, is provided with a substantially frictionless spacer, said spacer rising up to the top of said cup and thereby spacing said telescopic member from the top of said cup.

11. The portable single-cup washer as defined in claim 1, further including a heating element cooperating with an impeller and an outlet grille for drying.

12. The portable single-cup washer as defined in claim 1, wherein the water-spray nozzles define a rose at the top of the elongated member.

13. The portable single-cup washer as defined in claim 1, wherein said elongated member is pen-like, having a diameter ranging from from ¼ to 1 inch, and each of said radial blades has a length ranging from 2 to 6 inches.

14. The portable single-cup washer as defined in claim 2, wherein said telescopic member is pen-like, having a diameter ranging from from ¼ to 1 inch, and telescopically extending up to 6 inches, and each of said radial blades has a length ranging from 2 to 6 inches.

* * * * *